US009901145B2

(12) United States Patent
Baumann

(10) Patent No.: US 9,901,145 B2
(45) Date of Patent: Feb. 27, 2018

(54) BUCKLE

(71) Applicant: Andrea Baumann, Gresham, OR (US)

(72) Inventor: Andrea Baumann, Gresham, OR (US)

( * ) Notice: Subject to any disclaimer, the term of this patent is extended or adjusted under 35 U.S.C. 154(b) by 0 days.

(21) Appl. No.: 15/178,417

(22) Filed: Jun. 9, 2016

(65) Prior Publication Data

US 2016/0360839 A1 Dec. 15, 2016

Related U.S. Application Data

(60) Provisional application No. 62/173,270, filed on Jun. 9, 2015.

(51) Int. Cl.
*A44B 11/26* (2006.01)
*A44B 11/00* (2006.01)

(52) U.S. Cl.
CPC ..... *A44B 11/266* (2013.01); *A44D 2200/12* (2013.01)

(58) Field of Classification Search
CPC ..... A44B 11/266; A44B 11/008
See application file for complete search history.

(56) References Cited

U.S. PATENT DOCUMENTS 4,569,106 A 2/1986 Lovato
4,779,315 A 10/1988 Kohus
5,203,058 A 4/1993 Krauss
5,735,024 A 4/1998 Ortiz
D455,101 S 4/2002 Hamilton
6,571,434 B2 6/2003 Ortiz
D485,209 S 1/2004 Tracy et al.
6,826,806 B2 * 12/2004 Eaton ..... A44B 11/25 24/115 F
7,290,313 B2 11/2007 Southern
7,445,293 B2 * 11/2008 Smith ..... B60N 2/2812 24/614
8,225,468 B2 * 7/2012 Wanzenboeck ..... A41F 1/006 24/586.11
2003/0121129 A1 * 7/2003 Hamilton ..... A44B 11/266 24/615
2009/0119890 A1 * 5/2009 Laruccia ..... A44B 11/266 24/586.1

* cited by examiner

*Primary Examiner* — Robert Sandy
*Assistant Examiner* — David M Upchurch
(74) *Attorney, Agent, or Firm* — Alleman Hall Creasman & Tuttle LLP

(57) ABSTRACT

A buckle includes a first buckle piece and a second buckle piece each having a male connector portion and a female connector portion, the first buckle piece and the second buckle piece having a same configuration, wherein the male connector portion of each of the first buckle piece and the second buckle piece includes an arm with a releasable latch, and the female connector portion of each of the first buckle piece and the second buckle piece includes a receptacle for receiving an arm of the male connector portion of the other buckle piece and a catch for retaining the releasable latch of the other buckle piece.

17 Claims, 3 Drawing Sheets

BUCKLE

CROSS REFERENCE TO RELATED APPLICATIONS

This application claims priority to U.S. Provisional Application No. 62/173,270 entitled BUCKLE, filed Jun. 9, 2015, the entirety of which is hereby incorporated herein by reference.

BACKGROUND

Buckles may be used to fasten two items together. For example, buckles may be used to connect one or more straps on backpacks, belts, slings, etc.

SUMMARY

Various example buckles are disclosed. One example provides a buckle comprising a first buckle piece and a second buckle piece each comprising a male connector portion and a female connector portion, the first buckle piece and the second buckle piece having a same configuration, wherein the male connector portion of each of the first buckle piece and the second buckle piece comprises an arm with a releasable latch, and the female connector portion of each of the first buckle piece and the second buckle piece comprises a receptacle for receiving an arm of the male connector portion of the other buckle piece and a catch for retaining the releasable latch of the other buckle piece.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Many buckles take the form of a male piece that secures to one end of a strap and a female piece that secures to the other end of a strap. For example, a side release buckle may include a male piece having one or more prongs, and a female piece having a receptacle and one or more openings to releasably catch the prongs of the male piece. However, the use of different male and female pieces requires separate molds to produce each part. Further, in the event that a user breaks one of the parts, the user may have to buy both parts in a replacement kit, thus obtaining an unneeded part to replace the needed part.

Accordingly, examples are disclosed herein that relate to side release buckles that include the use of a single buckle piece design configured to latch to another piece of the same configuration. As described in more detail below, the buckle piece includes a male portion having an arm with a latch configured to be inserted in a female portion of another identical buckle piece, and a female portion having a receptacle and catch for receiving the latch of the male portion of the other identical buckle piece. The term "same configuration" is used herein to describe buckle pieces formed from a same mold and that are configured to connect to one another. In this sense, pairs of buckle pieces of the disclosed side release buckles may be considered to be "identical" to one another, although small variations may actually exist due to molding process tolerances, etc. The use of a single buckle piece design allows a single mold to be used to form both pieces of the buckle, rather than separate molds for male and female pieces. This may reduce tooling costs, and also may provide for the convenient manufacture and sale of standalone replacement pieces. Further, the disclosed examples include features that enable the buckle to be selectively used in a left-handed or right-handed configuration.

Figure 1:
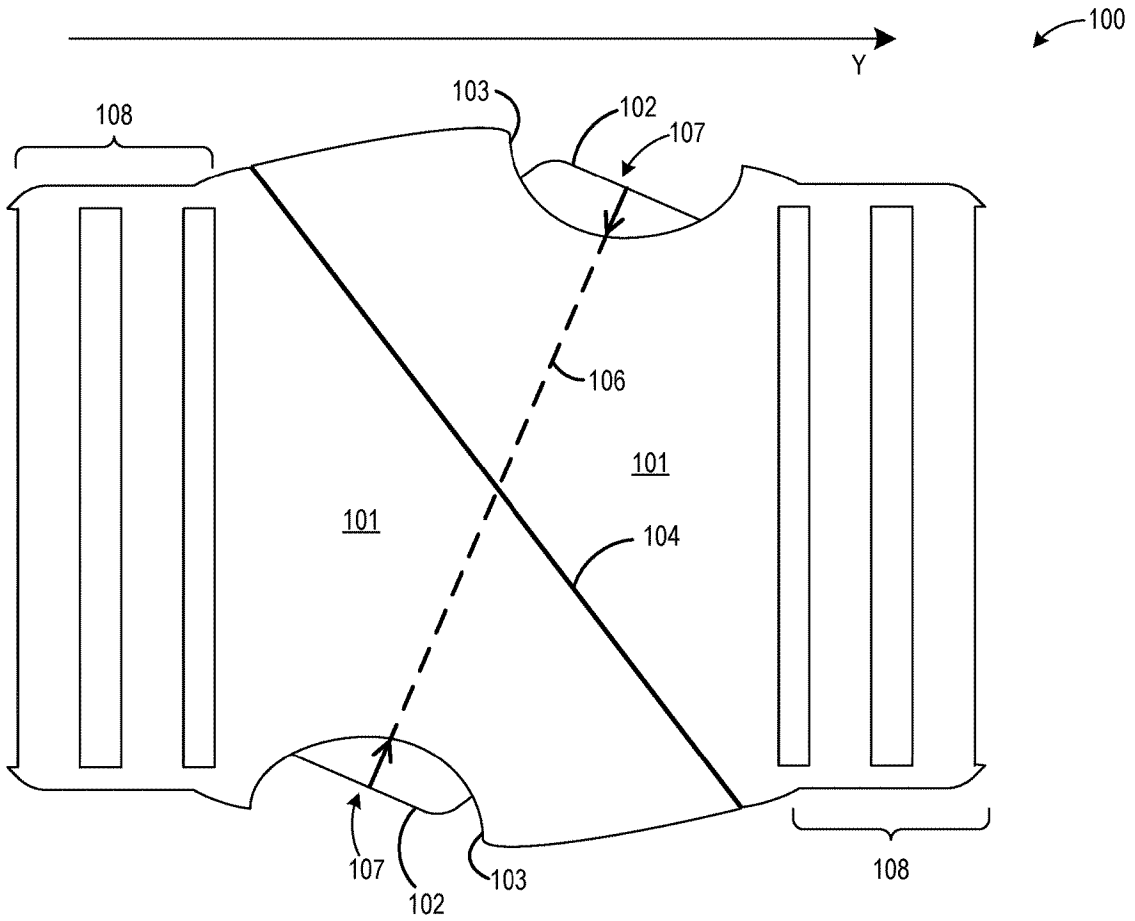
FIG. 1 shows an example buckle.

FIG. 1 shows an example buckle 100 comprising two identical buckle pieces 101 fastened together. Each buckle piece 101 includes a side release latch 102 secured in place by a catch 103 of the other buckle piece. Further, each buckle piece has a diagonally extending interface 104 at which it meets the other buckle piece. The side release latches 102 are offset diagonally from each other, for example, with respect to an axis of a long direction Y of the buckle. The two buckle pieces may be released from each other by pressing side release latches 102 toward each other along a diagonal axis 106 extending between the side release latches 102. The diagonal offset of the side release latches 102 may enable the side release latches 102 to be squeezed together with one hand while the hand and wrist are held in a comfortable position, compared to traditional side release latches that are not offset in such a manner. This may allow the two buckle pieces to be released by pressing the side release latches 102 in a fluid snapping motion of the hand. In the depicted example, each side release latch 102 includes a planar surface 107 that is oriented approximately normal to the axis 106 to make the release operation comfortable on a user's fingers. In other examples, this surface may have any other suitable configuration.

Figure 3:
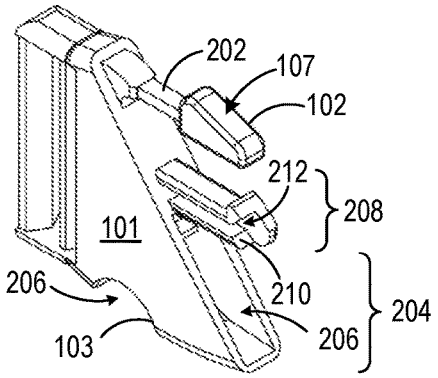
Figure 4:
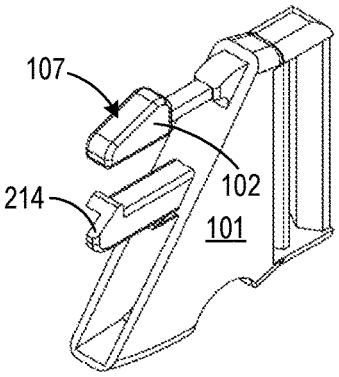
Figure 5:
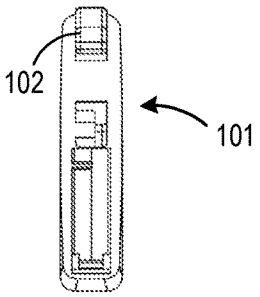

The relative locations of the top and bottom side release latches may be reversed by turning the buckle over. This may allow the buttons to be positioned either for left-handed operation or right-handed operation, as mentioned above. As such, a strap interface 108 of each buckle may be designed such that a strap can be inserted into the strap interface 108 from either side for retention. For example, the strap interface 108 may include strap retention features that are symmetrical along a longitudinal plane of the buckle—e.g. a plane parallel to direction Y in one dimension and normal to the page in the other dimension, bisecting the buckle. The strap interface 108 is described in more detail below with regard to FIG. 3.

FIGS. 2-5 show various views of buckle piece 101. As mentioned above, buckle piece 101 includes a male portion 200 that includes an arm 202 on which the releasable latch 102 is located, and also a female portion 204 including a receptacle 206 for receiving the male portion of another buckle piece. The female portion 204 includes a side opening 206 that defines a catch 103 for retaining the releasable latch of the other buckle piece.

The buckle piece 101 also includes a middle prong 208 that includes a tongue and groove configuration. The tongue 210 of middle prong 208 is configured to fit within the groove 212 of the middle prong of the other buckle piece when buckled, thereby providing additional stability to the buckle when two buckle pieces are engaged. The middle prong 208 may further help guide the two buckle pieces together when engaging the pieces. A distal end 214 of the middle prong 208 may have a tapered shape, as depicted, to help avoid any blocking, accidental catching, or any other difficulties that may arise when engaging the pieces. It will be understood that the middle prong may have any other suitable configuration, and may be omitted in some examples.

Figure 2:
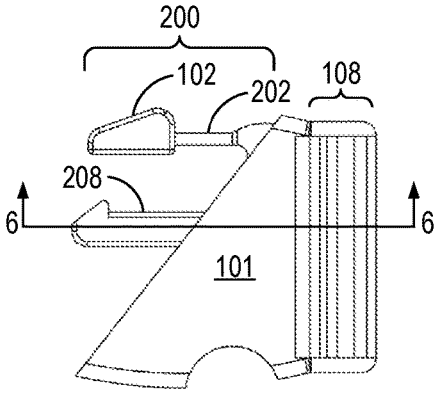
FIGS. 2-5 show various views of an example buckle piece of the buckle of FIG. 1.
Figure 6:
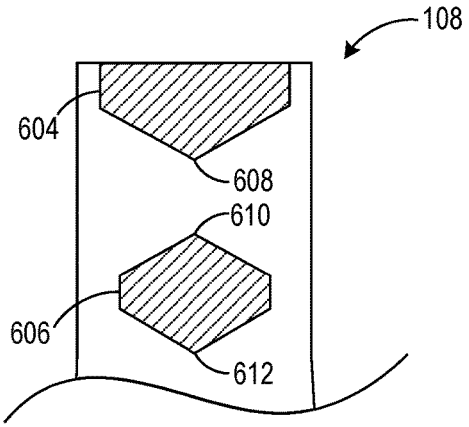
FIG. 6 shows a side cross-section view of the buckle piece of FIGS. 2-5.
Figure 8:
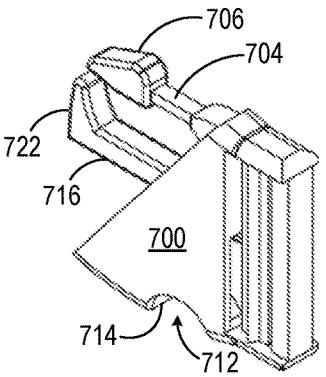
FIGS. 7-10 show various views of another example buckle piece.

FIG. 6 shows a cross-sectional view of the buckle piece 101 taken along section 6-6 of FIG. 2, and illustrates the strap interface 108 in more detail. The strap interface 108 includes opposing strap engagement features 604 and 606, each having mirror plane symmetry along a plane that bisects features 604 and 606. This is in contrast with conventional side release buckles, which generally do not include strap engagement features having such symmetry. The symmetric strap engagement features 604, 606 have corners 608, 610, and 612 that frictionally engage a strap surface when looped through the interface 302, thus helping to prevent strap slippage. The symmetry of the strap interface 108 allows a strap to be fitted through the interface 108 in the same manner from either side of the buckle piece, thus contributing to the reversibility of the buckle. In other examples, the symmetric strap engagement features may include any other suitable number of corners than the number of corners shown, and further may include any other suitable catch points than the corners 608, 610, and 612.

FIGS. 7-10 show various views of another example buckle piece 700. Buckle piece 700 includes a male portion 702 that includes an arm 704 on which a releasable latch 706 is located, and a female portion 708 including a receptacle 710 for receiving the male portion of another buckle piece. The female portion 708 includes a side opening 712 that defines a catch 714 for retaining the releasable latch of the other buckle piece. Buckle piece 700 also includes a middle prong 716 that includes another example of a tongue and groove configuration configured to provide additional stability when two of the buckle pieces 700 are engaged. In this example, the tongue 718 is configured to fit within the groove 720 of the middle prong of the other buckle piece when buckled. In contrast to the tapered shape of the middle prong of FIGS. 2-5, a distal end 722 of middle prong 716 has a widened shape, which allows for guided insertion of the tongue 718 into the groove of the other buckle piece.

Figure 10:
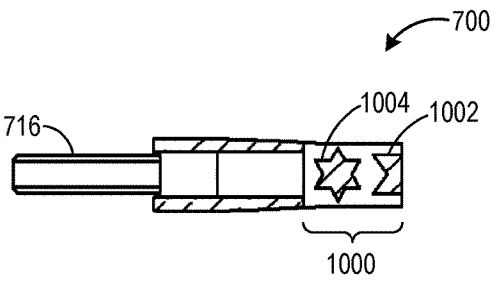
Figure 7:
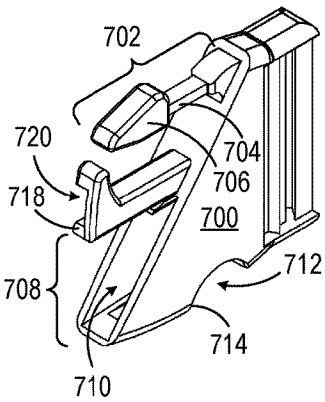
Figure 9:
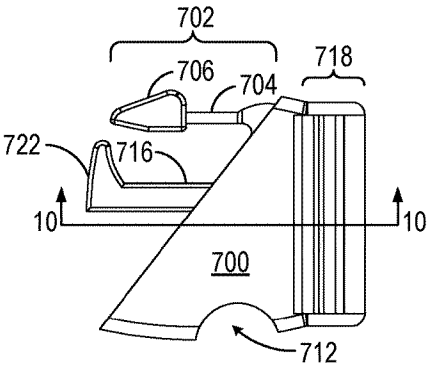

FIG. 10 shows a cross-sectional view taken along section 10-10 of FIG. 9, and illustrates another example symmetrical strap interface 1000 including opposing strap engagement features 1002 and 1004, each having mirror plane symmetry along a plane that bisects features 1002 and 1004. The symmetric strap engagement features 1002, 1004 each have a plurality of corners that frictionally engage a strap when looped through the strap interface 1000. In contrast to the strap engagement features shown in FIG. 6, strap engagement feature 1004 has a star-shaped configuration that includes a greater number of corners, and thus may provide a greater amount of friction for engaging a strap. As mentioned above, a symmetrical strap interface allows a strap to be fitted through in the same manner from either side of the buckle piece, allowing reversibility of the buckle. In combination with the reversibility of the releasable side latches when two of the buckle pieces are buckled, the buckle pieces as disclosed herein may allow the buckle to be easily switched to and from left-handed and right-handed configurations.

It is to be understood that the configurations described herein are exemplary in nature, and that these specific embodiments or examples are not to be considered in a limiting sense, because numerous variations are possible. The subject matter of the present disclosure includes all novel and non-obvious combinations and sub-combinations of the various devices and configurations, and other features, functions, and/or properties disclosed herein, as well as any and all equivalents thereof.

The invention claimed is:

1. A buckle, comprising:

a first buckle piece and a second buckle piece each comprising a male connector portion and a female connector portion, the first buckle piece and the second buckle piece having a same configuration, wherein the male connector portion of each of the first buckle piece and the second buckle piece comprises an arm with a releasable latch, and the female connector portion of each of the first buckle piece and the second buckle piece comprises a receptacle for receiving an arm of the male connector portion of the other buckle piece and a catch for retaining the releasable latch of the other buckle piece, wherein the buckle is configured to be released by application of force on a planar surface of the releasable latch of the first buckle piece and on a planar surface of the releasable latch of the second buckle piece along a diagonal axis extending between the releasable latch of the first buckle piece and the releasable latch of the second buckle piece, the diagonal axis being diagonal with respect to an axis of a long direction of the buckle, wherein the planar surface of the releasable latch of the first buckle piece and the planar surface of the releasable latch of the second buckle piece each is oriented normal to the diagonal axis extending between the releasable latch of the first buckle piece and the releasable latch of the second buckle piece, and wherein each of the first buckle piece and the second buckle piece comprises a strap interface, each strap interface comprising symmetric, opposing strap engagement features, each strap engagement feature configured to frictionally engage a strap, and each strap engagement feature having symmetry along a plane that bisects a corner of the strap engagement feature.

2. The buckle of claim 1, wherein each of the first buckle piece and the second buckle piece comprises a diagonally extending interface with respect to an axis of a long direction of the buckle configured to meet with the diagonally extending interface of the other buckle piece.

3. The buckle of claim 1, wherein the releasable latches of the first and second buckle pieces are diagonally offset when the first and second buckle pieces are latched together.

4. The buckle of claim 1, wherein each of the first buckle piece and the second buckle piece further comprises a prong configured such that the prong of the first buckle piece and the prong of the second buckle piece interface when buckled.

5. The buckle of claim 4, wherein the prong of each of the first buckle piece and the second buckle piece comprises a tongue and groove configuration.

6. A buckle, comprising:

a first buckle piece and a second buckle piece configured to releasably engage each other, the first buckle piece comprising a male connector portion comprising an arm with a releasable latch, a female connector portion comprising a receptacle for receiving an arm of the second buckle piece and a catch for retaining a releasable latch of the second buckle piece, wherein the releasable latches of the first and second buckle pieces are diagonally offset when the first and second buckle pieces are latched together, and a prong configured to interface with a prong of the second buckle piece, and wherein the buckle is configured to be released by application of force on a planar surface of the releasable latch of the first buckle piece and on a planar surface of the releasable latch of the second buckle piece along a diagonal axis extending between the releasable latch of the first buckle piece and the releasable latch of the second buckle piece, the diagonal axis being diagonal with respect to an axis of a long direction of the buckle, wherein the planar surface of the releasable latch of the first buckle piece and the planar surface of the releasable latch of the second buckle piece each is oriented normal to the diagonal axis extending between the releasable latch of the first buckle piece and the releasable latch of the second buckle piece, and wherein each of the first buckle piece and the second buckle piece comprises a strap interface, each strap interface comprising strap engagement features each having a corner with mirror plane symmetry along a plane that bisects the corner.

7. The buckle of claim 6, wherein each strap interface comprises symmetric, opposing strap engagement features.

8. The buckle of claim 7, wherein the symmetric opposing strap engagement features of each of the first and second buckle pieces are symmetrical along a longitudinal plane of the buckle.

9. The buckle of claim 6, wherein the second buckle piece has a same configuration as the first buckle piece.

10. The buckle of claim 6, wherein the second buckle piece comprises a male connector portion comprising the arm on which the releasable latch of the second buckle piece is located.

11. The buckle of claim 6, wherein that the buckle is configured to be released when a force is applied along a diagonal axis extending from the releasable latch of the first buckle piece to the releasable latch of the second buckle piece.

12. The buckle of claim 6, wherein the prong of each of the first buckle piece and the second buckle piece comprises a tongue and groove configuration.

13. A buckle, comprising:

a first buckle piece and a second buckle piece configured to releasably engage each other, the first buckle piece comprising a male connector portion comprising an arm with a releasable latch, and a female connector portion comprising a receptacle for receiving an arm of the second buckle piece and a catch for retaining a releasable latch of the second buckle piece, wherein each of the first buckle piece and the second buckle piece comprises a diagonally extending interface with respect to an axis along a long direction of the buckle configured to meet with the diagonally extending interface of the other buckle piece, and wherein the buckle is configured to be released by application of force on a planar surface of the releasable latch of the first buckle piece and on a planar surface of the releasable latch of the second buckle piece along a diagonal axis extending between the releasable latch of the first buckle piece and the releasable latch of the second buckle piece, the diagonal axis being diagonal with respect to the axis of the long direction of the buckle, and wherein the planar surface of the releasable latch of the first buckle piece and the planar surface of the releasable latch of the second buckle piece each is oriented normal to the diagonal axis extending between the releasable latch of the first buckle piece and the releasable latch of the second buckle piece, and wherein each of the first buckle piece and the second buckle piece comprises a strap interface, each strap interface comprising a symmetric, opposing strap engagement features.

14. The buckle of claim 13, wherein each strap interface has mirror plane symmetry along a plane that bisects corners of the symmetric, opposing strap engagement features.

15. The buckle of claim 13, wherein the second buckle piece has a same configuration as the first buckle piece.

16. The buckle of claim 13, wherein the arm of the second buckle piece and the releasable latch of the second buckle piece are on a male connector portion of the second buckle piece.

17. The buckle of claim 13, wherein each of the first buckle piece and the second buckle piece further comprises a prong configured to interface with the prong of the other buckle piece.

* * * * *